US006776733B2

(12) United States Patent
Schroeder

(10) Patent No.: US 6,776,733 B2
(45) **Date of Patent: *Aug. 17, 2004**

(54) OVERHEAD SUPPORTED NET SYSTEM

(75) Inventor: Edward A. Schroeder, Marengo, IL (US)

(73) Assignee: Porter Athletic Equipment Company, Broadview, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/228,076

(22) Filed: Jan. 7, 1999

(65) Prior Publication Data

US 2001/0002377 A1 May 31, 2001

(51) Int. Cl.[7] ..... A63B 67/00
(52) U.S. Cl. ..... 473/473; 473/482
(58) Field of Search ..... 473/473, 482, 473/481; 182/155; 297/158.4

(56) References Cited

U.S. PATENT DOCUMENTS

| | | | | |
|---|---|---|---|---|
| 1,778,173 A | | 10/1930 | Steele | |
| 1,919,494 A | * | 7/1933 | Albach | 473/482 |
| 2,865,634 A | * | 12/1958 | Townsend | 473/482 |
| 2,958,528 A | | 11/1960 | Wikelund | |
| 2,961,236 A | | 11/1960 | Murphy | |
| 3,065,964 A | | 11/1962 | Barnes | |
| 3,561,759 A | | 2/1971 | Duganich | |
| 4,153,247 A | | 5/1979 | Burns | |
| 5,215,310 A | | 6/1993 | Allbright | |
| 5,393,069 A | | 2/1995 | Taylor | |

FOREIGN PATENT DOCUMENTS

SU 1535549 1/1990

OTHER PUBLICATIONS

Porter No. 955–W Center–Strut Ceiling–Suspended Side–Fold, Rear–Braced Backstop (28' to 40').
Porter No. 955 Center–Strut Ceiling Suspended Side Fold Backstop (18' to 28').
"Custom Built" Retractable Volleyball System, Designed, Manufactured & Installed by Quik Set Industries, Ozawkie, KS.

* cited by examiner

*Primary Examiner*—Paul T. Sewell
*Assistant Examiner*—M. Chambers
(74) *Attorney, Agent, or Firm*—Barnes & Thornburg

(57) ABSTRACT

An overhead supported net system including a net and a spaced pair of masts pivotally connected to an overhead structure to pivot about an axis parallel to the longitudinal axis of the net between a stored position and a play position. A pair of braces are connected to the overhead structure and the masts to lock the masts in the play position. The mast terminates short of the floor.

12 Claims, 3 Drawing Sheets

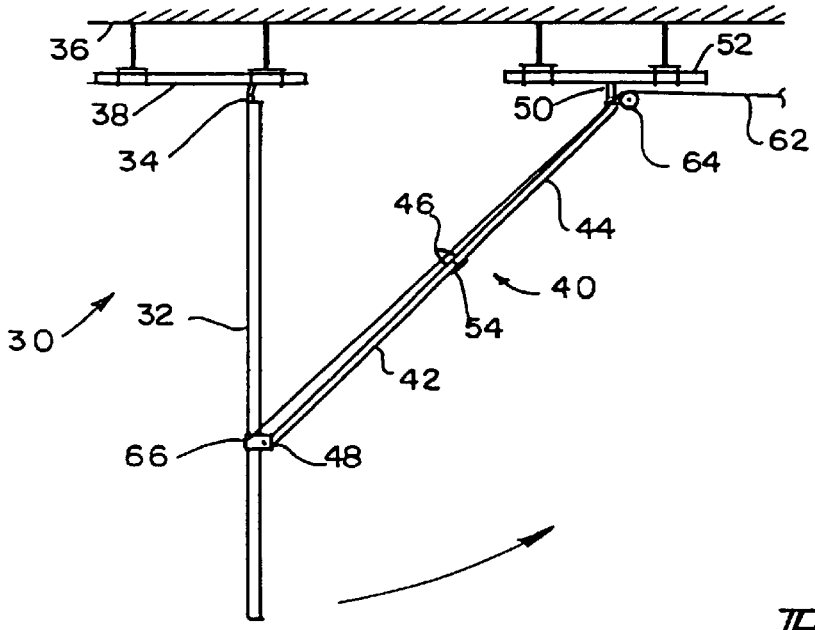
FIG. 2
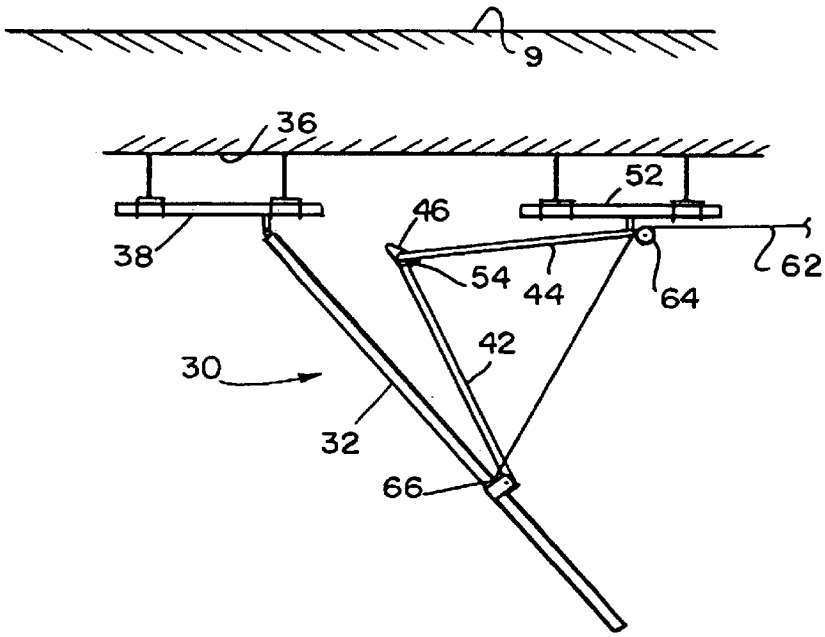
FIG. 3
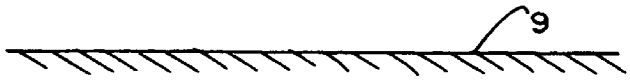

OVERHEAD SUPPORTED NET SYSTEM

BACKGROUND AND SUMMARY OF THE INVENTION

The present invention is related to a net system and more specifically, to an overhead supported net system.

Net systems generally include a pair of standards with a net strung therebetween. The standards are generally supported in sleeves in the floor of a gymnasium. Portable standards include a weighted base on wheels. In both systems, the net system must be disassembled and stored such that the gymnasium can be used for other sports. Such products that are well known are available from Porter Athletic Equipment Company.

The mounting of the net supports to the wall of a gymnasium is illustrated in U.S. Pat. No. 3,065,964. This structure required disassembly and storage of the net. The framework is collapsed against the wall. The support structure is terminated short of the floor and therefore would not damage the floor.

An overhead support for nets with a common retractable net system is presently available from QuikSet Industries of Ozawkie, Kans. The standards are each telescopic poles which extend down a vertical axis. The rigidity of the system is the forcing of the bottom element into the floor and locking it between the overhead structure and the floor. Thick rubber pads are necessary to protect the gym floor from scratches.

The present system is an overhead supported net system including a net and a spaced pair of masts pivotally connected to the overhead structure to pivot about an axis parallel to the longitudinal axis of the net between a stored position and a play position. A pair of braces are connected to the overhead structure and the masts to lock the masts in the play position. A driver, which may include cables, are connected to the masts and move the masts between the stored and play positions. The braces each include a pair of members hinged to each other at one end and connected to either the mast or the overhead structure at their other end. A latch is provided at the hinge to lock the pair of members and the mast in the play position. The braces are pivotally connected to the overhead structure and the mast. A height adjustment mechanism is provided connecting the net to the mast. The adjusting mechanism preferably includes a screw-drive. A platform ladder may also be connected to one of the masts. The masts and the ladder terminate short of the floor in the play position. In one embodiment, the bottom of the mast terminates adjacent the embodiment edge of the net.

Other objects, advantages and novel features of the present invention will become apparent from the following detailed description of the invention when considered in conjunction with the accompanying drawings.

BRIEF DESCRIPTION OF THE DRAWINGS

FIG. 2 is a side view of the system of FIG. 1 in the play position.

FIG. 3 is a side view of the net system of FIG. 1 between the play and stored positions.

DETAILED DESCRIPTION OF THE PREFERRED EMBODIMENTS

Figure 4:
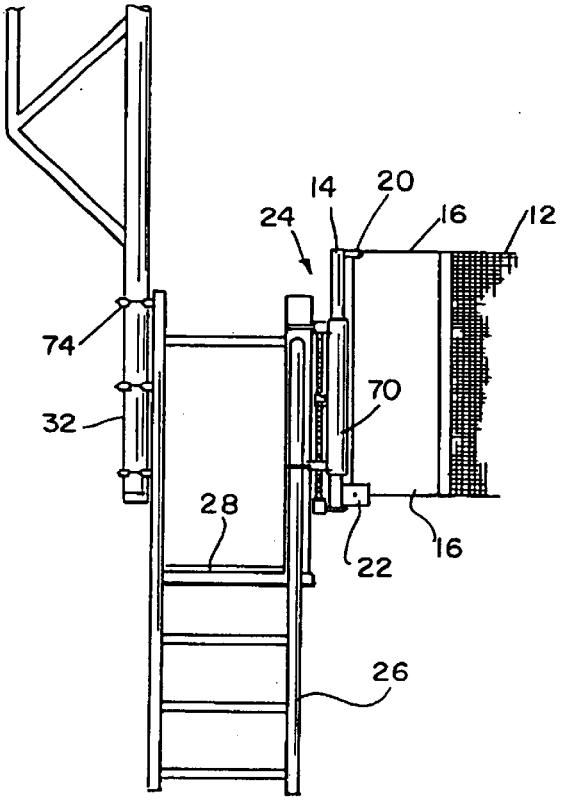
FIG. 4 is an enlarged view of the connection of the net to the mast of the system of FIG. 1.
Figure 4:
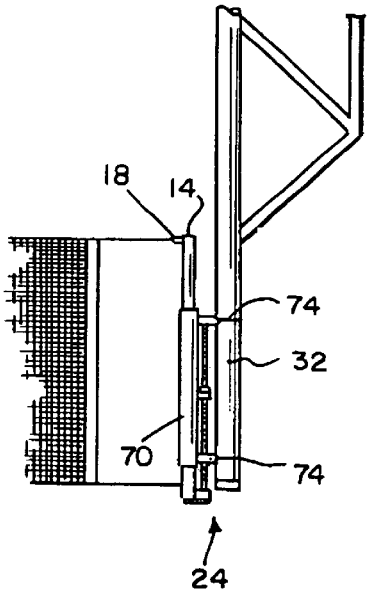

A net 12, for example, a volleyball net, is connected to supports 14 via cord 16 and hooks 18, pulley 20 and tensioning devices 22, for example a crank, which are mounted to the supports 14. This can best be seen in the details of FIGS. 4 and 5. Although the net system 10 being illustrated is for volleyball, the present overhead support structure may be used for any net game, including badminton, tennis, etc. Any form of connection of the net to the support 14 may be used. The hooks 18, pulley 20 and tension device 22 are merely examples.

Figure 1:
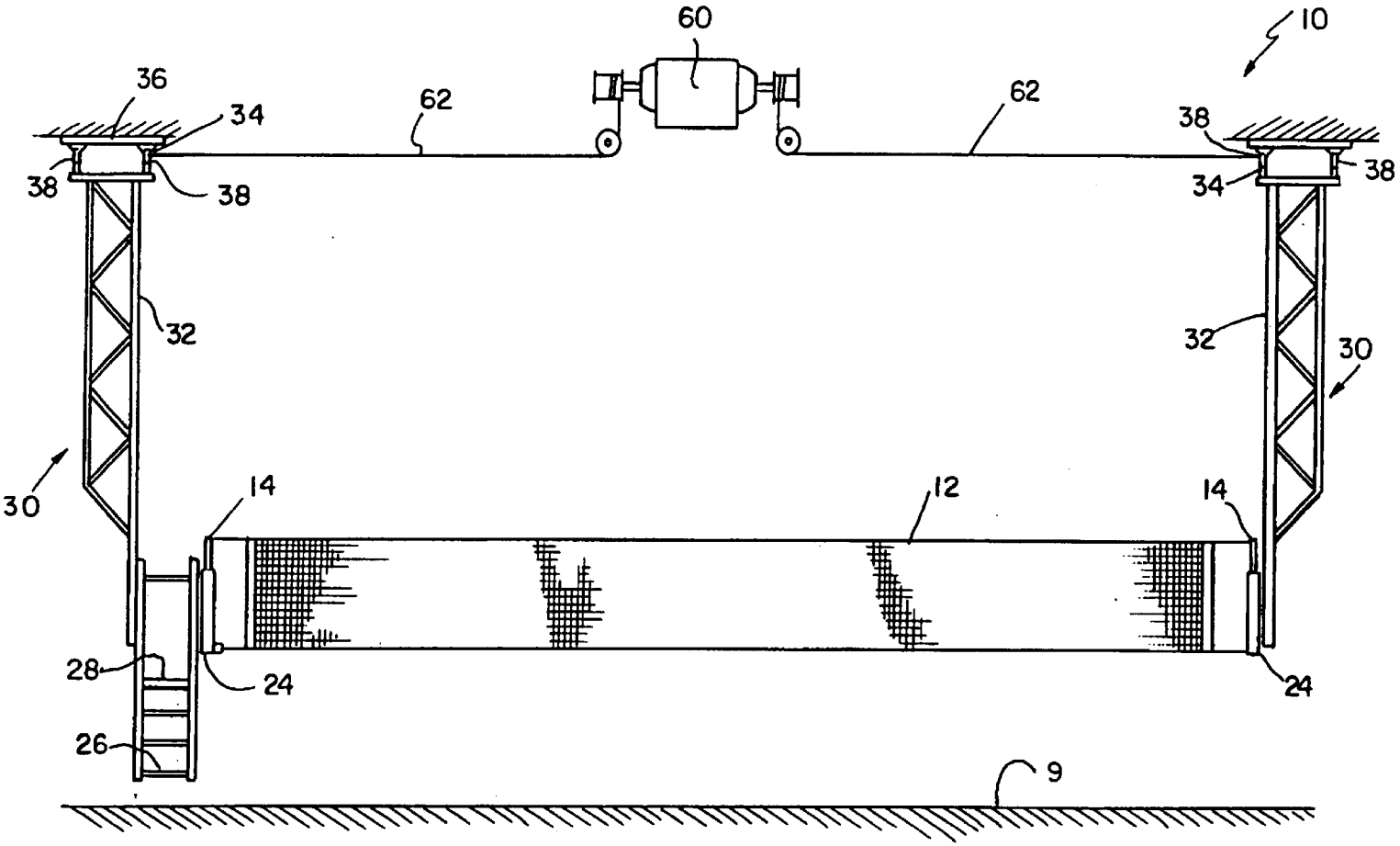
FIG. 1 is a front view of an overhead supported net system according to the principles of the present invention.

The net 12 via support 14, height adjustment device 24 and ladder 26 are connected to an overhead support system 30 as illustrated in FIG. 1. Although the height adjustment system 24, to be discussed in detail below with respect to FIG. 5, and the ladder are illustrated, both may be deleted. In such cases, the support 14 may be mounted directly to the overhead support system 30. As a further alternative, the overhead support system may include the connection system of the cords 16 of the net directly and thereby include hooks, pulleys and tension devices as needed.

The overhead support system as illustrated in FIGS. 1–3 includes a mast 32 pivotally supported at 34 to the overhead support 36 by element 38. The overhead support 36 may be the ceiling girder system of a gymnasium.

A brace 40, as illustrated in FIGS. 2 and 3, is connect between the mast 32 and the overhead support 36 and locks the mast 32 in the play position illustrated in FIGS. 1 and 2. When the brace 40 is unlocked, it allows the mast 32 to rotate up into a stored position adjacent the overhead support 36. FIG. 3 illustrates the mast 32 moving towards its stored position. Brace 40 is provided for each of the masts 32. The brace 40 preferably includes a pair of members 42 and 44 hinged together at the first ends by hinge 46. The other end of element 42 is pivotally connected at 48 to the mast 32. The other end of the element 44 is pivotally connected at 50 to support structure 36 by element 52. A latch structure 54 locks the elements 42 and 44 together in the play position as illustrated in FIG. 2. It may be unlatched to allow pivoting to position 1 of which is illustrated in FIG. 3.

A driver 60 illustrated as the motor is connected by cable 62 over pulley 64 on element 52 and connected at 66 to the mast 32. Thus, actuation of the motor 60 will cause simultaneous movement of the mast 32 between the stored and play positions.

It should be noted that the particular structure of the mast 32, the brace 40 and the driver 60 with wire 62 including latch 54 are well known elements and devices used in overhead supported basketball systems. Thus, detailed descriptions not provided are well within those of ordinary skill of the art. For example, the mast and brace are similar to "23" and "45" style basketball systems available from Porter Athletic Equipment Company. One specific example is Model 90955, ceiling suspended, side-fold, rear-braced backstop. The drive may be 00707-00 ¾ Hp winch with travelling clew assembly and ¼ inch aircraft cable. Each mast could also include a no. 10797-100 safe strip safety mechanism. All of these are available from Porter Athletic Equipment Company. It should be noted that the wire 62 in FIGS. 2 and 3 are indicated as dotted lines to allow a distinction from the other structure and are not considered hidden lines to the drawings.

As can be seen from FIGS. 1–3, the mast 32 pivot about an axis which is parallel to the longitudinal axis of the net to move between the stored position and the play position.

This allows the net to be moved between these two positions without disassembly and/or necessary adjustment of the tension. The rigid lock provided by braces 40 maintain the total support system 30 rigid without the necessity of engaging the floor 9. As shown in FIG. 1, not only do the masts 32 terminate short of the floor 9, but so does the ladder 26 of the judges platform 28. As can be seen in more detail in FIG. 4, preferably the mast 32 terminates adjacent the bottom edge of the net 12. Although not illustrated, appropriate padding can be provided around the lower portions of the mast 32 as well as the ladder 26 and its related platform 28.

Figure 5:
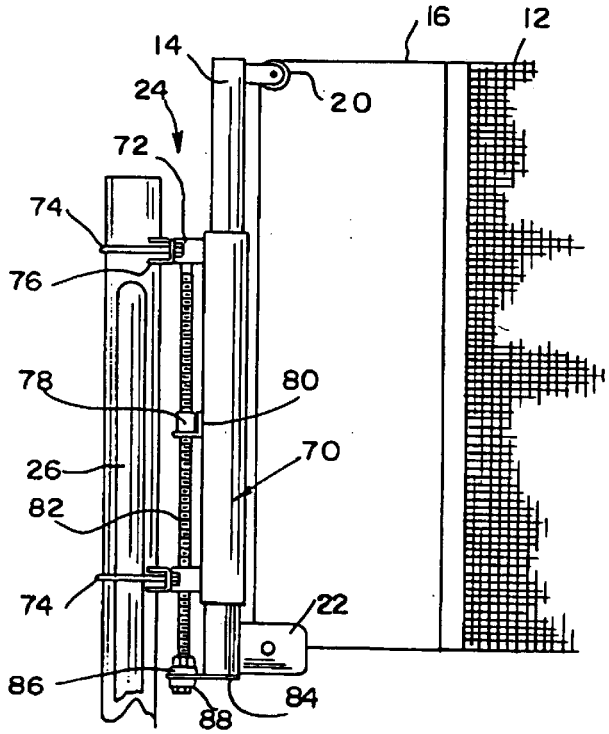
FIG. 5 is an enlarged view of the net adjustment system according to the principles of the present invention.

The height adjustment mechanism 24 which adjusts between the height shown in FIG. 1 and the lower position illustrated in phantom in FIG. 1, is shown in FIG. 5. The support 12 is received in a guide 70. The guide 70 is connected via bracket 72, U-bolt 74 and fastener 76 to either the mast 32 on the one side or to a portion of the ladder 26 on the other. One embodiment of a drive for the height adjustment includes a threaded element or bolt 78 welded by bracket 80 to the guide 70. A screw 82 is received in threaded element 78 and is secured to the support 14 by bracket of screw 82 and bearing 86. The end 84 receives a crank or other device to rotate the screw 82. U-bolt 74 and fastener 76 also connect the ladder 26 to one of the masts 32.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. An overhead supported system to suspend a net over a floor, the system comprising:

a net having a longitudinal axis;

a spaced pair of masts pivotally connected to an overhead structure to pivot about an axis parallel to the longitudinal axis of the net between a stored position and a play position; and a pair of braces, each brace coupled to the overhead structure adjacent a first end, and coupled to the masts adjacent a second end to lock the masts in the play position, wherein the system does not contact and is not secured to the floor.

2. A system according to claim 1, including a driver connected to the masts for moving the mast between the stored and play positions.

3. A system according to claim 2, including cables connecting the driver to each mast.

4. A system according to claim 1, wherein each pair of braces includes a pair of members hinged to each other adjacent one end and coupled to either the mast or overhead structure adjacent another end.

5. A system according to claim 4, including a latch at the hinge to lock the pair of members and the mast in the play position.

6. A system according to claim 1, wherein the braces are pivotally connected to the overhead structure and the mast.

7. A system according to claim 1, including a height adjustment mechanism connecting the net to the mast.

8. A system according to claim 7, wherein the adjustment mechanism includes a screw drive.

9. A system according to claim 1, including a platform and a ladder connected to one of the masts.

10. A system according to claim 9, wherein neither the masts nor the ladder touch the floor when the net is in the play position.

11. A system according to claim 1, wherein the masts do not touch the floor when the net is in the play position.

12. A system according to claim 1, wherein a bottom of each mast terminates adjacent a bottom edge of the net.

* * * * *